US008490533B2

(12) United States Patent
Reynard et al.

(10) Patent No.: US 8,490,533 B2
(45) Date of Patent: Jul. 23, 2013

(54) PROGRAMMING DEVICE FOR THE FUSE OF A PROJECTILE

(75) Inventors: Laurent Reynard, Bourges (FR); Fabrice Sanchez, Bourges (FR)

(73) Assignee: Nexter Munitions, Versailles (FR)

( * ) Notice: Subject to any disclaimer, the term of this patent is extended or adjusted under 35 U.S.C. 154(b) by 425 days.

(21) Appl. No.: 12/897,178

(22) Filed: Oct. 4, 2010

(65) Prior Publication Data

US 2012/0255426 A1 Oct. 11, 2012

(30) Foreign Application Priority Data

Nov. 6, 2009 (FR) ..... 09 05361

(51) Int. Cl.
*F42C 17/00* (2006.01)

(52) U.S. Cl.
USPC ..... 89/6; 89/6.5

(58) Field of Classification Search
USPC ..... 89/6, 6.5, 1.814, 1.1; 102/207, 270, 102/209
See application file for complete search history.

(56) References Cited

U.S. PATENT DOCUMENTS 1,739,921 A * 12/1929 Gietmann et al. ..... 89/1.1
2,465,351 A * 3/1949 Busignies et al. ..... 102/209
4,022,102 A * 5/1977 Ettel ..... 89/6.5
4,080,869 A * 3/1978 Karayannis et al. ..... 89/6.5
4,142,442 A * 3/1979 Tuten ..... 89/6.5
4,237,789 A * 12/1980 Stauers et al. ..... 102/270
4,300,452 A * 11/1981 Beuchat et al. ..... 102/270
4,327,625 A * 5/1982 Beuchat et al. ..... 89/6
4,480,523 A * 11/1984 Young et al. ..... 89/8
4,649,796 A * 3/1987 Schmidt ..... 89/6.5
4,711,152 A * 12/1987 Fortunko ..... 89/6.5
5,117,733 A * 6/1992 Fischer et al. ..... 89/6.5
5,160,801 A * 11/1992 Andersen et al. ..... 89/6
5,343,795 A * 9/1994 Ziemba et al. ..... 89/6.5
5,894,102 A * 4/1999 Oberlin et al. ..... 89/6.5
6,170,377 B1 * 1/2001 Larsson et al. ..... 89/6.5
7,077,045 B2 * 7/2006 Dietrich et al. ..... 89/6
7,698,849 B2 * 4/2010 O'Dwyer et al. ..... 89/14.05
7,975,593 B2 * 7/2011 Schneider et al. ..... 89/6.5
8,113,102 B2 * 2/2012 Magnan et al. ..... 89/6.5
8,215,220 B2 * 7/2012 Magnan et al. ..... 89/6.5
2010/0147141 A1 * 6/2010 Magnan et al. ..... 89/6.5
2011/0083547 A1 * 4/2011 Schneider et al. ..... 89/6.5
2012/0011991 A1 * 1/2012 Magnan et al. ..... 89/6

OTHER PUBLICATIONS

French Search Report issued in French Application No. 09 05361 on Jun. 8, 2010 (with translation).

* cited by examiner

*Primary Examiner* — Jonathan C Weber
(74) *Attorney, Agent, or Firm* — Oliff & Berridge, PLC

(57) ABSTRACT

A programming device for the fuse of a projectile using programming coils transmitting a programming signal by induction to a receiver integral with the fuse, wherein the programming coils are integral with a substantially cylindrical wall of a corridor in which the projectile translates axially, the programming coils being made in the form of several elementary coils each encircling a ferrite core parallel to the axis of the corridor, the coils being distributed along several lines parallel to the corridor axis, the coils of one line being longitudinally staggered with respect to the coils of the neighboring line or lines.

10 Claims, 4 Drawing Sheets

PROGRAMMING DEVICE FOR THE FUSE OF A PROJECTILE

BACKGROUND OF THE INVENTION

1. Field of the Invention

The technical scope of the invention is that of devices enabling a projectile fuse to be programmed.

2. Description of the Related Art

A fuse is an electronic or electromechanical device that enables the ignition of the projectile's explosive load to be activated.

Fuses may be of the time or proximate type or else may control the functioning upon impact on a target. They are sometimes multi-mode and in this case enable the projectile to be doted with functioning upon impact or time functioning, according to the user's choice.

Multi-mode or time fuses must be programmed before firing. Such programming is, for example, the selection of the functioning mode (multi-mode fuse) and/or the time between firing and detonation (timing information).

Today, such fuse programming is made more often than not by induction using programming coils.

U.S. Pat. No. 5,117,733 discloses an induction coil to program medium caliber projectile fuse during the rotation of the projectile in the feed star of a weapon.

This device comprises two coils: one coil to detect an approaching projectile and one coil to program the fuse. When a projectile is detected by the first coil, the second coil is activated and emits the programming signal for the fuse.

Such a device thus implements a single programming coil which has a profile selected such that part of the coil is always facing the fuse during part of the forward movement of the projectile in the weapon's feed corridor.

Such a solution is, however, extremely disadvantageous from the industrial point of view, since the energy level implemented by this single coil leads to control electronics being designed that are oversized with respect to needs. Such electronics are not highly compatible with the power networks available in the turret of a weapon system.

Furthermore, the electromagnetic losses in the weapon structure and the induced radiation are very high.

Because of integration constraints it may be necessary to ensure the programming of the fuse during a phase in which the projectile is translating along its axis. Such a displacement occurs in particular when the projectile is being introduced into the weapon chamber.

The device proposed by U.S. Pat. No. 5,117,733 is not adapted to the programming of a fuse having such a translational movement. Indeed, in the structure described by U.S. Pat. No. 5,117,733, the path followed by the projectile carrying the fuse is circular and the fuse is thus always facing the programming coil during this path with optimal coil/fuse coupling since the fuse's receiver coil is substantially facing the median zone of the programming coil where the flux is at its highest.

If such a coil is positioned in the arc of a circle along part of a rectilinear corridor, coupling is acceptable but because of the translational movement of the projectile, the projectile rapidly moves away from this coil.

The implementation of U.S. Pat. No. 5,117,733 would thus require coils of substantial size to be made that cover the length of the corridor. Such coils would consume a lot of energy. It would then be necessary for several coils to be arranged in the arc of a circle (analogous to those described by U.S. Pat. No. 5,117,733) and parallel to one another for the fuse to be constantly facing one of these coils as it translates in front of the coils.

However, this solution presents other problems.

Firstly, such coils are complicated in structure. The winding of flat wires and the assembly of ferrites tightly encircled by the loops is difficult to produce.

Then, the coils arranged side by side leave zones between the coils in which the magnetic field is reduced, thereby reducing the effectiveness of the programming and the energizing of the fuse.

Lastly, the energy needed to simultaneously power all the coils is substantial, once again leading to the definition of oversized control electronics with respect to the need.

SUMMARY OF THE INVENTION

The aim of the present invention is to overcome such drawbacks by proposing a programming device in which the coils implemented are inexpensive and arranged and powered so as to ensure optimal coupling with the projectile fuse while limiting the energy requirements.

Thus, the invention relates to a programming device for the fuse of a projectile using at least one programming coil transmitting a programming signal by induction to receiver means integral with the fuse, device wherein the coils are integral with a substantially cylindrical wall of a corridor in which the projectile translates axially, the coils being made in the form of several elementary coils each encircling a ferrite core parallel to the axis of the corridor, the coils being distributed along several lines parallel to the corridor axis, the coils of one line being longitudinally staggered with respect to the coils of the neighboring line or lines.

Each coil is more particularly linked to electronic control means that ensure the simultaneous powering of all the coils arranged in a given plane perpendicular to the corridor axis, the coils of the different planes being powered successively as the projectile advances in the corridor, the coils located in a same plane being powered when the projectile is located in the vicinity of said plane.

In a first embodiment, the two lines of lateral coils (lines having only one neighboring line) are not staggered with respect to one another, all the other lines of coils being positioned between these lateral lines being gradually staggered by a given amount and following the direction in which the projectile advances.

According to a second embodiment, the lines of coils are globally divided in two groups, staggered longitudinally with respect to one another, the lines of one group alternating with the lines of the other group.

Advantageously, the device will comprise at least a first position sensor linked to the electronic control means, such sensor enabling the position of the fuse to be determined with respect to the coils as the projectile moves forward.

The first position sensor may be arranged in a first housing positioned between two lines of coils and at one inlet end of the corridor.

The first position sensor may furthermore be coupled with at least a second position sensor linked to the electronic control means, second sensor enabling the progression rate of the projectile in the corridor to be determined.

The second position sensor may be arranged in a second housing positioned between two lines of coils and at one outlet end of the corridor.

The electronic control means may comprise a power stage comprising amplifiers to power one or several coils and a control stage to ensure the piloting of the different amplifiers, the control stage also ensuring the opening of a contactor positioned between the power supply and the power stage with no signal is being transmitted to the amplifiers.

BRIEF DESCRIPTION OF THE DRAWINGS

The invention will become more apparent from the following description of the different embodiment, such description made with reference to the appended drawings, in which.

DETAILED DESCRIPTION OF PREFERRED EMBODIMENTS

Figure 1:
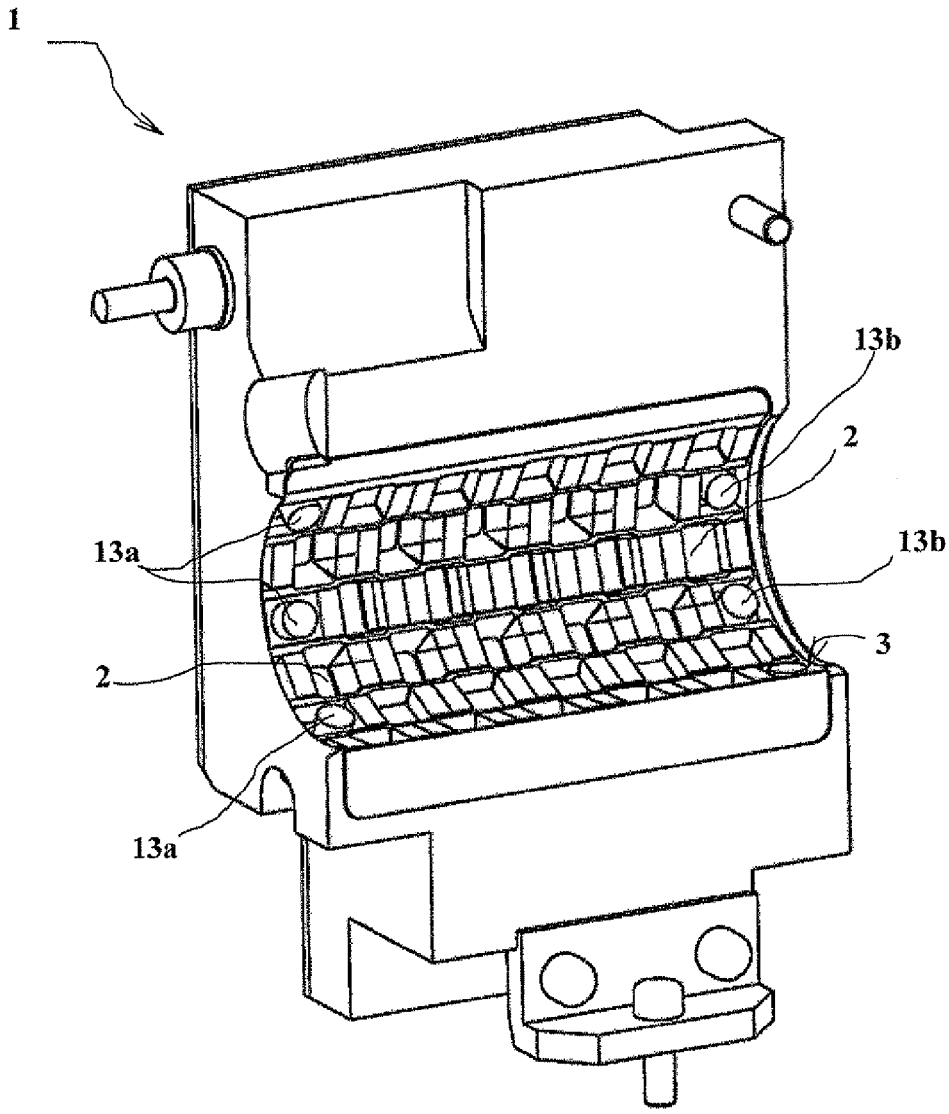
FIG. 1 is a schematic perspective view of a programming device according to one embodiment of the invention.

FIG. 1 shows a programming device 1 for a projectile fuse that implements programming coils 2 which transmit a programming signal by induction to receiver means integral with the projectile fuse (not shown in this Figure).

The different coils 2 are integral with a substantially cylindrical wall 3 that is integral with a corridor of the weapon through which the projectile translates axially.

Such corridors are usually situated in the vicinity of the weapon chamber. The translational movement of a projectile along its axis generally occurs slightly before the introduction of the projectile into said chamber.

Figure 2:
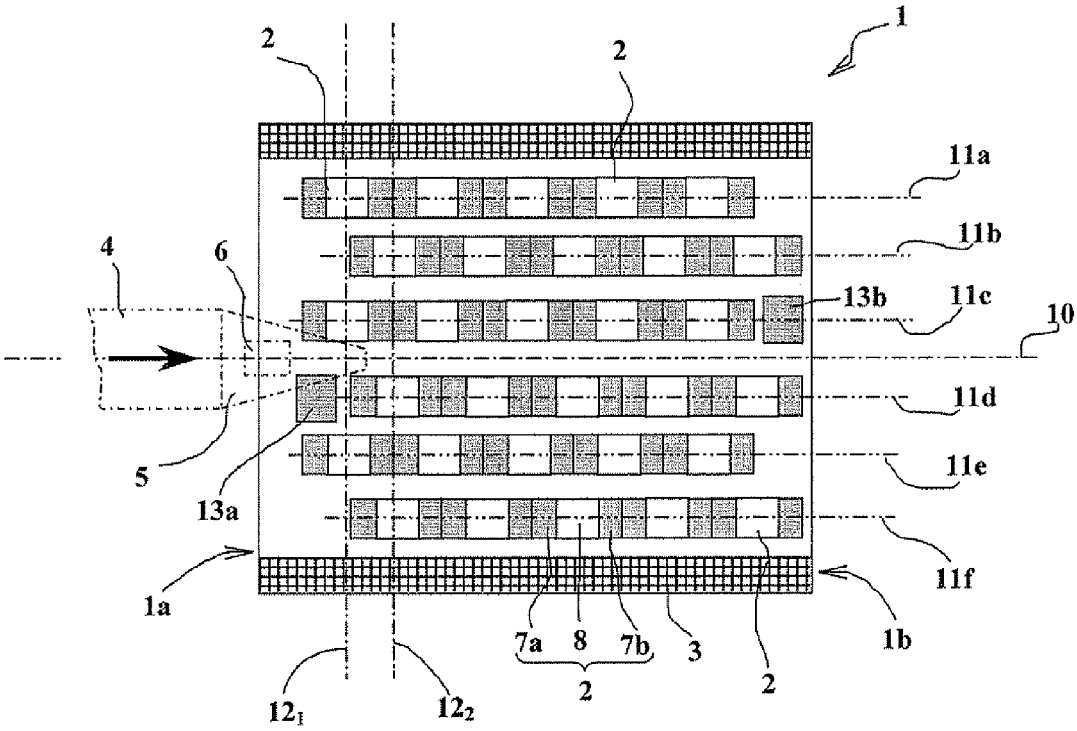
FIG. 2 is a schema showing the relative positioning of a projectile and of the programming device according to the invention, FIG. 3 schematizes control means implemented with the device according to the invention.

FIG. 2 shows a lateral view of the device 1 and a projectile 4 incorporating a fuse 5 in its nose cone that incorporates receiver means 6 for the programming signal, such as a receiver coil. The receiver coil may also be located at the projectile's base or else in the base of a shell of the ammunition (namely for programming large caliber ammunition, which is to say of a caliber greater than or equal to 90 mm).

Figure 4A:
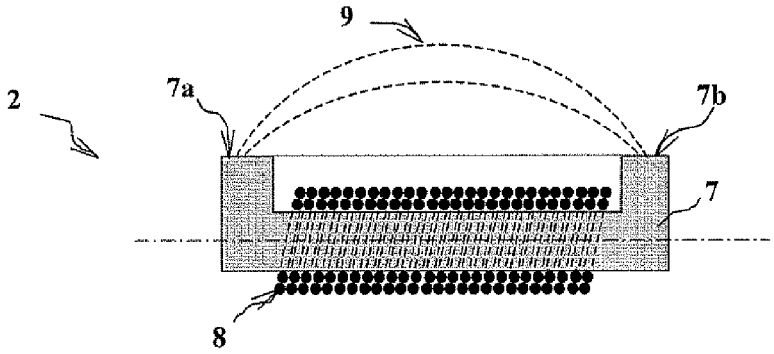
FIGS. 4*a* and 4*b* show two orthogonal views of an elementary coil implemented in a device according to the invention.
Figure 4B:
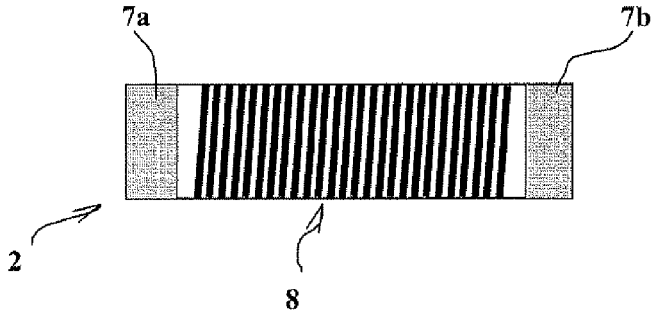

FIGS. 4*a* and 4*b* show an enlarged view of a coil 2 implemented in the device according to the invention. Such a coil 2 incorporates a U-shaped ferrite core 7 around which a conductor 8 is wound that is linked to electronic control means. The specific shape of the ferrite core 7 defines the two poles 7*a* and 7*b* of the coil. The lines of the field 9 that will be generated by the coil extend from one pole 7*a* to the other 7*b*. Such coils are standard off-the-shelf components available in a wide variety of sizes (for example 25 mm×12 mm×12 mm). They are usually used to produce electric transformers.

In accordance with one characteristic of the invention, the programming device implements several elementary coils in which the ferrite cores 7 are all parallel to the corridor's axis 10, which is also the axis along which the projectile 4 advances in direction F.

The coils 2 are furthermore distributed along several lines 11 (11*a* . . . 11*i* . . . 11*j* . . . ) parallel to the axis 10 of the corridor.

According to the embodiment shown here (FIG. 2), the device comprises six parallel lines 11, 11*b*, 11*c*, 11*d*, 11*e* and 11*f* each comprising five coils 2. The device thus incorporates thirty elementary coils 2.

Using such an arrangement, it is now possible for the programming signal's power to be optimally spread over the different coils.

It is, in fact, needless to power the coils positioned in the vicinity of the outlet 1*b* of the device when the projectile 4 is in the vicinity of the inlet 1*a* (and vice versa).

Each coil 2 is thus linked to electronic control means that ensure the simultaneous supply of all the coils arranged in a same plane 12, perpendicular to the corridor's axis 10 and passing by the receiver means 6 integral with the projectile fuse 5.

According to the configuration adopted, such a plane encompasses one or several coils.

Thus, it is sure that only those coils 2 that are the best positioned to supply the fuse 5 are implemented thereby limiting the amount of energy consumed.

So as to be able to power only those coils which are the best position with respect to the fuse 5 the relative position of the fuse 5 and coils must be identified.

For this, the proposed device implements a first position sensor 13*a* that is linked to the electronic control means. This sensor is positioned in the vicinity of the inlet end 1*a* of the corridor. This position sensor may be associated with a forward motion sensor to measure the progress rate of the projectile which could be located upstream of the corridor.

Two position sensors may thus be provided that are arranged at the corridor's inlet and that are axially offset with respect to one another. Such a solution, however, requires the corridor to be of sufficient length.

In the event of the projectile 4 being equipped with a base fuse (and not a nose fuse as shown in the Figures), a second position sensor 13*b* may be provided in the vicinity of the outlet. This sensor will detect the passage of the projectile's nose cone in the vicinity of the outlet. At this instant, the base fuse is not yet in the vicinity of the coils and the programming has not yet been performed.

The measurement of the time at which the nose cone enters the corridor associated with that of its exiting the corridor will enable the progress rate of the projectile to be determined and the power sequence of the different coils 2 to be activated.

By way of a variant, the nose cone exit measurement can be used to stop the programming thereby optimizing the energy supplied. This detection device adds the enormous advantage of being able to perform the programming of the projectile fuse whatever the progress rate of the projectile in front of the programmer.

By way of a variant, several position sensors 13*a* and 13*b* may be positioned in the same plane at the inlet and outlet of the corridor. These sensors will be mounted parallel to one another. This ensures a duplication of the detection means thereby making the device more reliable. FIG. 1 thus shows three position sensors 13*a* and three position sensors 13*b*.

Staggering the lines 11 of coils enables these three sensors to be easily housed in the spaces created by such staggering.

The configuration proposed by the invention in which elementary coils of relatively reduced size are used that are distributed along lines 11 enables good coupling between the coil 2 and the receiver means 6 to be ensured.

Indeed, when the coils located in a same plane 12*i* are powered, the receiver means 6 are in the vicinity of the median zone separating the two poles of the coil, thus the zone in which the field is at its highest.

Such a solution is more advantageous than that which would consist in making a single coil stretched to cover the whole line. Coupling would in that case only be optimal at a median part of the corridor whereas the energy required by the coil would be greater.

Figure 3:
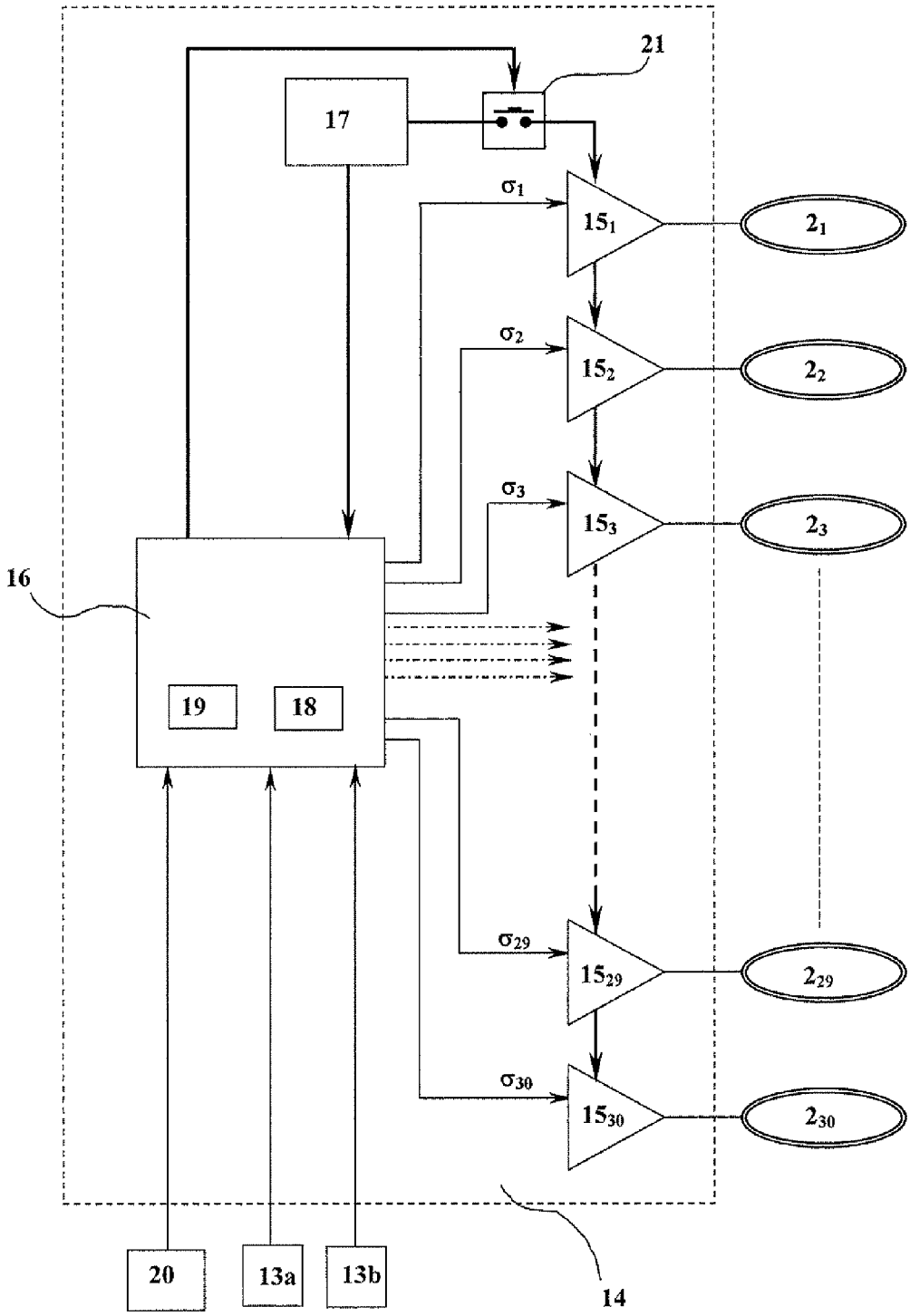

FIG. 3 schematizes control means 14 to control the different coils 2.

These control means 14 comprise a power stage constituted by the amplifiers $\mathbf{15}_1$ to $\mathbf{15}_{30}$ (one amplifier per coil 2) and a control stage 16 constituted by a programmable calculator, for example a pre-programmed component (for the sake of clarity, the Figure only shows a few amplifiers and coils).

The control means 14 also comprise an energy supply stage (for example, a battery) which powers the different amplifiers $\mathbf{15}_i$ as well as the control stage 16.

Classically, the control stage 16 incorporates a timer 18 and one or several memories 19. It furthermore receives the signals supplied by the position sensor(s) 13*a*, 13*b* and is linked to a turret calculator (which supplies the elements to be programmed) or directly to a programming interface 20 (a keyboard, for example) by which a user introduces the required value(s) for the programming of the fuses.

The control stage 16 will be able to individually program each amplifier $\mathbf{15}_i$. Classically in the domain, for example to control audio amplifiers, piloting an amplification stage will consist in applying to the latter a signal $\sigma_i$ of variable frequency and amplitude.

The variation in amplitude of each signal $\sigma_i$ will enable the amplitude of the output signal from the amplifier $\mathbf{15}_i$ to be piloted between a minimal value (zero) and a maximal value which is the maximal value provided by the sizing of the amplifier.

Programming the data is performed by piloting the signal $\sigma_i$ in all or nothing respecting the binary coding proposed by STANAG 4547 (NATO standard). The fuse will naturally incorporate a demodulation stage enabling the restitution of the programming received.

An algorithm memorized in the control stage 16 will enable the determination of the value to be given at any time for each signal $\sigma_i$ according to the programming given by the interface 20 that is required according to the location of the projectile fuse 5 with respect to each coil (or plane of coils $\mathbf{12}_i$). Such location is determined thanks to the first position sensor 13*a* and to the progress rate determination means (value memorized in memory 19 or else value measured by another sensor, such as the second sensor 13*b*).

According to another characteristic of the invention, a contactor 21 is positioned between the power supply 17 and the different amplifiers $\mathbf{15}_i$. This contactor is controlled by the control stage 16 so as to ensure the power supply to the different amplifiers $\mathbf{15}_i$ only when an emission is effectively planned. Such an arrangement avoids the excessive heating of the amplifiers in standby mode and enables a reduction in the consumption of energy. Indeed, whether the latter are supplied by a control signal or not, the power signal is in principle, always applied and this would result in heating.

The control signal $\sigma_i$ applied to each amplifier will furthermore be of variable intensity depending on the location of the fuse 5 with respect to the plane of the coil $\mathbf{12}_i$ in question. It is pointless, in fact, to power the coils located at a distance from the plane $\mathbf{12}_i$ in which the fuse is located at any give time. The information supplied by the position sensors 13*a* and 13*b* is used to determine which coils are to be powered at any given time.

By way of a variant, one amplifier 15*i* may furthermore power several coils mounted in parallel (the coils located in the same plane $\mathbf{12}_i$).

A process to gradually activate the coils in correlation with the progression of the projectile is disclosed in patent application FRO8-06484 made on 18 Nov. 2008 to which reference may be made for further details. According to this patent, the power supply for each coil is ensured by control time slots or else by ramp waves of intensity increasing with the approach of the coil and decreasing as the coil moves away.

FIG. 2 shows that the different coils arranged on a same line $\mathbf{11}_i$ are in contact by their poles. Thus, when the coils are being powered there is a zone between the coils in which the magnetic field is weaker.

In accordance with another characteristic of the invention, the coils of one line $\mathbf{11}_i$ are staggered longitudinally with respect to the coils of the neighboring line(s).

Figure 5:
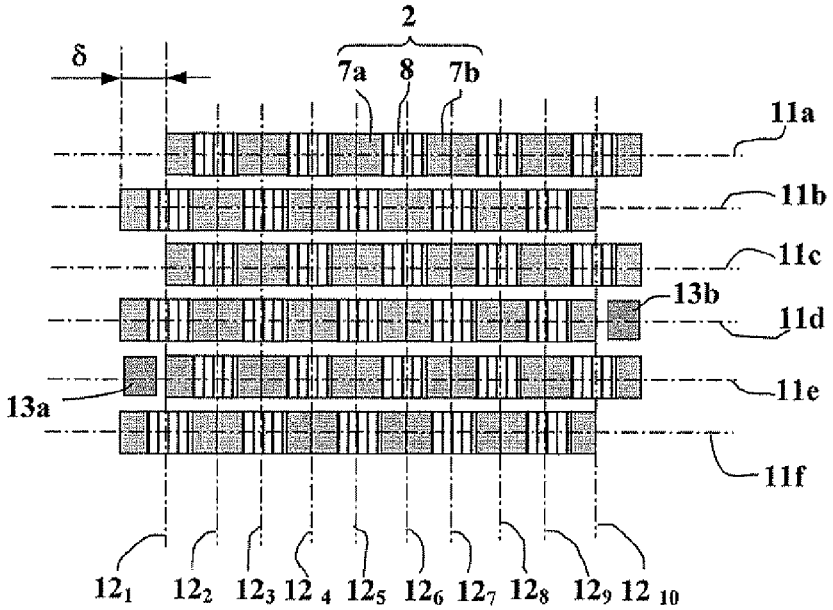
FIG. 5 shows the distribution of the coils according to a first embodiment of the invention.

FIG. 5 thus shows a device according to a first embodiment of the invention in which the lines $\mathbf{11}_i$ of coils 2 are globally distributed into two groups that are offset longitudinally with respect to one another, the lines of one group alternating with the lines of the other group.

A first group is formed by the coils of lines 11*a*, 11*c* and 11*e*. A second group is constituted by the coils of lines 11*b*, 11*d* and 11*f*.

The second group is staggered longitudinally with respect to the first by a distance 5 substantially equal to half the length of an elementary coil 2.

Thus the coils of each group are arranged facing the spaces between the coils of the other group. A better distribution of the programming flux is thereby ensured as the projectile progresses through the corridor.

This is particularly important to optimize the energetic coupling when the programming device also ensures the energy supply for the fuse's electronics.

FIG. 5 shows the different planes $\mathbf{12}_i$ that are powered successively as the projectile progresses through the corridor.

According to this embodiment, each plane comprises three different coils. Thus, the plane 12*i* comprises the first coils of lines 11*b*, 11*d* and 11*f*.

The device thus comprises ten successive parallel planes with 3 coils each.

This embodiment constitutes the optimal configuration. Indeed, each plane incorporates the same number of coils and the signal is thus of substantially constant power as the projectile progresses from one plane to another.

As the projectile 4 progresses along the wall 3 of the corridor, the control means 14 will ensure the successive supply of all the coils located in a same plane 12*i* passing by the fuse 5 of the projectile 4. The control means 14 thus firstly power the first coils in plane $\mathbf{12}_1$ then those of plane $\mathbf{12}_2$ and so on until reaching the last coils in plane $\mathbf{12}_{10}$.

The Figure shows that by staggering the lines $\mathbf{11}_i$, the sensors 13*a* and 13*b* may be easily housed between two neighboring lines. This limits the axial bulk of the programming device and facilitates its integration into a feed system.

Figure 6:
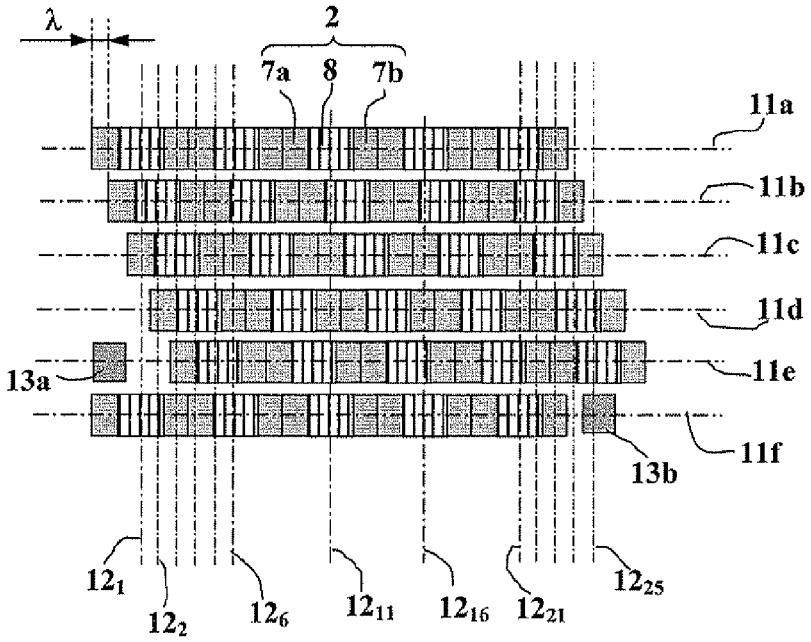
FIG. 6 shows a distribution of the coils according to a second embodiment of the invention.

FIG. 6 shows another embodiment of the invention in which the two lines of lateral coils 11*a* and 11*f*, which is to say the lines that only have one neighboring line, are not offset longitudinally with respect to one another.

All the other lines arranged between these two lateral line (that is to say lines 11*b*, 11*c*,11*d* and 11*e*) are, on the contrary, gradually and regularly staggered by a given amount $\lambda$ and following the direction in which the projectile progresses.

Different planes 12*i* are thus materialized comprising, depending on the case, either one or two coils. The planes comprising two coils are planes associating two coils of the lateral lines 11*a* and 11*f*. The other planes only comprise a single coil of any given line.

The Figure shows that there are thus 25 parallel planes ($\mathbf{12}_1$ to $\mathbf{12}_{25}$) and that there are four successive planes that only incorporate a single coil between two planes incorporating two coils. Such a configuration is slightly more bulky axially.

However, it enables the radiation energy (and thus the energy consumed by the device) to be reduced. In fact, the number of coils which are powered at any given time (one or two coils) is thus reduced.

This embodiment also enables housings to be delimited in which to position the position sensors 13*a* and 13*b*.

What is claimed is:

1. A programming device for programming a fuse of a projectile, the programming device comprising:

programming coils transmitting a programming signal by induction to a receiver means integral with the fuse, wherein the programming coils are integral with a substantially cylindrical wall of a corridor in which the projectile translates axially, the programming coils are made in the form of several elementary coils each encircling a ferrite core parallel to an axis of the corridor, the programming coils are distributed along several lines parallel to the corridor axis, and the programming coils of one line of the several lines are longitudinally staggered with respect to the programming coils of a neighboring line or lines.

2. The programming device according to claim 1, the programming device further comprising:

an electronic control unit, wherein each programming coil of the programming coils is linked to the electronic control unit, the electronic control unit ensures simultaneous powering of all of the programming coils arranged in one of different planes perpendicular to the corridor axis, the programming coils of the different planes are powered successively as the projectile advances in the corridor, and the coils located in a first plane of the different planes are powered when the projectile is located in the vicinity of the first plane.

3. The programming device according to claim 2, wherein the electronic control unit comprises:

a power stage comprising amplifiers to power one or several of the programming coils; and a control stage to ensure the piloting of the amplifiers, the control stage also ensuring the opening of a contactor positioned between a power supply and the power stage when no signal is being transmitted to the amplifiers.

4. The programming device according to claim 1, wherein a first line and a last line of the several lines, which have only one neighboring line, are not staggered with respect to one another, a plurality of intermediate lines of the several lines are positioned between the first line and the last line and are gradually staggered by a given amount in a direction in which the projectile advances.

5. The programming device according to claim 4, the programming device further comprising:

an electronic control unit; and at least a first position sensor linked to the electronic control unit, wherein the sensor enables the position of the fuse to be determined with respect to the programming coils as the projectile moves forward.

6. The programming device according to claim 5, wherein the first position sensor is arranged in a first housing positioned between two lines of the several lines and at a first inlet end of the corridor.

7. The programming device according to claim 5, wherein the first position sensor is coupled with at least a second position sensor linked to the electronic control unit, the second sensor enabling the progression rate of the projectile in the corridor to be determined.

8. The programming device according to claim 7, wherein the second position sensor is arranged in a second housing positioned between two lines of the several lines and at a second outlet end of the corridor.

9. The programming device according to claim 1, wherein the several lines are globally divided into a first and a second group, the first and second groups are staggered longitudinally with respect to one another, and lines of the first group alternate with lines of the second group.

10. The programming device according to claim 9, the programming device further comprising:

an electronic control unit; and at least a first position sensor linked to the electronic control unit, wherein the sensor enables the position of the fuse to be determined with respect to the programming coils as the projectile moves forward.

* * * * *